US010981394B2

(12) United States Patent
Döbelt et al.

(10) Patent No.: US 10,981,394 B2
(45) Date of Patent: Apr. 20, 2021

(54) METHOD FOR PRINTING A VARYING PATTERN OF LANDING ZONES ON A SUBSTRATE BY MEANS OF INK-JET PRINTING

(71) Applicants: PLASTIC LOGIC GMBH, Dresden (DE); NOTION SYSTEMS GMBH, Schwetzingen (DE)

(72) Inventors: Andreas Döbelt, Dresden (DE); Rolf Schneider, Heidelberg (DE); Jan Schönefeld, Leimen (DE); Michael Doran, Dossenheim (DE)

(73) Assignee: PLASTIC LOGIC HK LIMITED, Central (HK)

( * ) Notice: Subject to any disclaimer, the term of this patent is extended or adjusted under 35 U.S.C. 154(b) by 0 days.

(21) Appl. No.: 16/348,038

(22) PCT Filed: Nov. 9, 2017

(86) PCT No.: PCT/EP2017/001300
§ 371 (c)(1),
(2) Date: May 28, 2019

(87) PCT Pub. No.: WO2018/099583
PCT Pub. Date: Jun. 7, 2018

(65) Prior Publication Data

US 2019/0337302 A1 Nov. 7, 2019

(30) Foreign Application Priority Data

Nov. 8, 2016 (EP) ..... 16197851

(51) Int. Cl.
*B41J 2/21* (2006.01)
*B41J 2/045* (2006.01)
*B41J 25/00* (2006.01)

(52) U.S. Cl.
CPC ..... *B41J 2/2132* (2013.01); *B41J 2/04505* (2013.01); *B41J 25/003* (2013.01); *B41J 2/04586* (2013.01)

(58) Field of Classification Search
CPC ..... B41J 29/38; B41J 2/2132; B41J 2/04505; B41J 2/04586; B41J 25/003
See application file for complete search history.

(56) References Cited

U.S. PATENT DOCUMENTS

2014/0184683 A1 7/2014 Harjee et al.
2015/0298454 A1 10/2015 Fukazawa

FOREIGN PATENT DOCUMENTS

TW 201636717 A 10/2016
WO 2013145801 A1 10/2013

OTHER PUBLICATIONS

International Search Report issued in PCT/EP2017/001300 dated Apr. 13, 2018.

*Primary Examiner* — Jannelle M Lebron
(74) *Attorney, Agent, or Firm* — Heslin Rothenberg Farley and Mesiti PC; Nicholas Mesiti

(57) ABSTRACT

The object of the invention, which relates to a method for printing a substrate by means of inkjet printing, is to enable precise printing of a landing point matrix, which is displaced, rotated, or distorted, particularly not linearly distorted, as compared to an ideally orthogonal landing point matrix, with less complexity. Said object is achieved in that the lateral resolution is selected to be large enough that the smallest distance between nozzle lines is less than the minimum distance between the landing zone rows, and that, with a variation, specified by the substrate, of the distance of adjacent landing zone rows between various landing zone lines (distortion), the position of the landing zones of a landing zone line is determined relative to the nozzle lines and consequently only the printhead nozzles having a nozzle (Continued)

Figure 1:
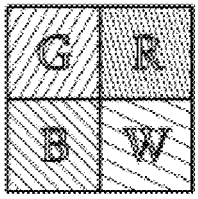

line intersecting a landing zone are actuated according to a nozzle actuation scheme and the corresponding landing zone type.

21 Claims, 8 Drawing Sheets

METHOD FOR PRINTING A VARYING PATTERN OF LANDING ZONES ON A SUBSTRATE BY MEANS OF INK-JET PRINTING

CROSS REFERENCE TO RELATED APPLICATIONS

This application is the National Phase filing under 35 U.S.C. § 371 of International Application No.: PCT/EP2017/001300, filed on Nov. 9, 2017, and published on Jun. 7, 2018 as WO 2018/099583 A1, which claims priority to German Application No.: 16197851.5, filed on Nov. 8, 2016. The contents of each of the prior applications are hereby incorporated by reference herein in their entirety.

The invention relates to a method for printing a substrate by means of inkjet printing. In this process, there are landing zones on the substrate, which correspond to a landing zone type, consisting of landing zone lines and landing zone rows aligned vertically thereto. The landing zone matrix is aligned relative to the print head such that the landing zone rows extend essentially parallel to the print direction, and the actuation of the print head takes place such that one or more drops of one or more printhead nozzles generates a pattern of landing points within the landing zone. In doing so, the printhead nozzles create imaginary nozzle lines on the substrate surface with a lateral resolution representing the distance between the nozzle lines.

In particular, the invention relates to the printing of both rigid and flexible substrates, in which a predefined quantity of functional liquid (known as ink here) is intended to be metered in multiple landing zones such as, for example, sensor surfaces, pixels, reaction surfaces for medical applications, etc.

The method requires, of course, that the position of the landing zones on the substrate be at least approximately known.

BACKGROUND ART

In order to determine the position of the landing zones, it is known to be possible to determine the orientation of the substrate relative to the print heads, for example using a camera which records an alignment marking on the substrate, and the coordinate position of the substrate is determined with a subsequent pattern detection process. The alignment markings would have been applied to the substrate in upstream production steps and thus represent the geometry of the substrate in the pattern detection process.

However, it is essentially also possible to determine the orientation of the substrate and the position of individual landing zones directly, that is not from the alignment markings applied by means of the prior production steps but rather, for example, by means of detection of the landing zones as a result of an indicating of same, for example by means of a physical activation.

A substrate may have one or more types of landing zones. Different types of landing zones can be metered, for example, with different inks or may have different geometries. Furthermore, multiple substrates may be processed simultaneously.

The following terms are surmised herein.

Print Direction:

The print direction is the direction in which the print head is moved relative to the substrate with the output of drops by means of printhead nozzles.

Nozzle Line:

The movement of the print head generally takes place as a linear movement. The projection onto the surface of the substrate of an executed line of movement of a printhead nozzle is characterized as the nozzle line. The nozzle line is not a physical line but rather imaginary.

Landing Zones:

Landing zones are areas on the substrate in which a predefined quantity of functional liquid (known as ink here) is intended to be metered. Said landing zones may serve, for example, to establish sensor surfaces, pixels, reaction surfaces for medical applications, etc. The landing zones have a target position defined before the printing.

Landing Zone Type:

A substrate may have one or more landing zone types. Different landing zone types may be metered, for example, with different inks, ink quantities, landing points, or the like, or have different geometries.

Landing Zone Matrix:

The pattern to be generated on the substrate is created from a landing zone matrix, which is arranged in landing zone rows and landing zone lines. If the landing zone matrix is aligned relative to the movement of the print head, the landing zones positioned one after the other in the print direction form the landing zone rows and the landing zones positioned next to one another vertical to the print direction form the landing zone lines.

Actuation of a Printhead Nozzle:

The actuation of a printhead nozzle causes the output of a drop from the printhead nozzle. Due to the actuation, the drop volume and/or the number of drops can furthermore be controlled.

Landing Point:

The landing point is the surface center of gravity of the surface on the substrate, which is wetted upon contact with a drop of ink from a printhead nozzle.

Lateral Resolution:

The lateral resolution is the number of nozzle lines per unit of length, which have a smallest distance a to one another between the nozzle lines. The smallest distance a can be modified through the following measures, individually or in combination:

a) through an increase in the number of print nozzles per unit of length of a printhead nozzle line and/or b) through the arrangement of at least one second printhead nozzle line transverse to a first printhead nozzle line offset transverse to the print direction and/or c) through a static distortion of the print head such that its printhead nozzle line(s) form an angle between >0° and <90° and/or d) through an n-fold traversing of the print head relative to the substrate, wherein the print head is moved with each passage, for example, by an amount $$x = i * a + \frac{a}{n},$$

where i=0, 1, 2, 3 . . . transverse to the print direction. An increase in the lateral resolution in this case means a reduction in the distance a.

Nozzle Actuation Scheme:

It may be provided that an actuation algorithm is applied to the specification for actuating the nozzles, which specifies which of the printhead nozzles, which could actually be actuated because their nozzle line intersects a landing zone, are not to be actuated.

The prior art of the aforementioned method for metering functional liquids on substrates is that such a metering task is implemented by means of dispensers, chemical vapor deposition, analog printing methods, as well as inkjet printing. The invention relates to inkjet printing.

In many applications, it is generally advantageous to limit the variation of the metered quantity per landing zone type, for example to meter active OLED material or even color filters for displays, but also active sensor materials, in a reproducible manner, such that, in the finished product, the variation in the functional properties of the landing zones within a substrate does not exceed predefined limits. This is necessary in order to maintain, for example, the luminous intensity variation within a display but also the variation in the sensitivity of a signal from sensor to sensor as part of a parent substrate within the tolerable limits.

When using inkjet printing for metering, it is prior art that the exact same number of inkjet drops is placed on the landing points in landing zones that should fulfill the same function.

It is further prior art that an attempt is made to adapt the lateral resolution advantageously to that of the landing zone matrix by means of rotation of the print heads and/or of the substrate. Said adaptation is carried out such that the largest number of nozzle lines possible intersects the landing zones.

There are situations in which the adaptation of the lateral resolution to the landing zone matrix cannot be implemented through rotation or, however, the complex rotation of print heads and/or substrates should be avoided entirely or, however, a print head should be used that does not permit any continual adaptation of the resolution by means of rotation such as, for example, high-performance modern print heads with more than one nozzle line.

The rotation of the print heads and/or of the substrate is not practical for implementation, for example, in the following situations:

a) The substrate has a production-related distortion in the landing zone matrix with respect to an ideally orthogonal landing zone matrix which does not enable an alignment of the nozzle lines to a large number of landing zones of the substrate. This is the case, for example, with flexible substrates.

b) The landing zones are not sufficiently evenly distributed on a matrix—either due to production or intentionally—such that no practical alignment can be found.

SUMMARY OF THE INVENTION

The invention relates to the previously described situations in which the adaptation of the lateral resolution to the landing zone matrix should not be implemented or cannot be implemented and/or is not advantageous by means of a rotation of the print head relative to the substrate or—more precisely—to the print direction.

Thus, the object of the invention is to indicate a method for printing a substrate by means of inkjet printing, with which a precise printing of a landing point matrix, which is displaced, rotated, or distorted, particularly not linearly distorted, as compared to an ideally orthogonal landing point matrix, is to be enabled with less complexity.

Said object is achieved according to the present invention in that, with a method of the aforementioned type, 1. the lateral resolution is selected to be large enough such that the smallest distance between nozzle lines is less than the minimum distance between the landing zone rows and
2. with a variation, specified by the substrate, of the distance of adjacent landing zone rows between various landing zone lines (distortion), the position of the landing zones of a landing zone line is determined relative to the nozzle lines and consequently only the printhead nozzles having a nozzle line intersecting a landing zone are actuated according to a nozzle actuation scheme and the corresponding landing zone type.

In one embodiment of the method, it is provided that the lateral resolution is increased by the selection of a print head with a number of print nozzles in a printhead nozzle line, the distance of which is less than the minimum distance between the landing zone rows.

The method can be embodied in that the lateral resolution is increased by the selection of a print head in which at least one second printhead nozzle line is arranged offset with respect to a first printhead nozzle line transverse to the print direction.

It is also possible for the lateral resolution to be increased by means of a rotation of the print head relative to the print direction such that its printhead nozzle line(s) form an angle between >0° and <90° with respect to the print direction.

A further option is that the lateral resolution be increased by means of an n-fold traversing of the print head relative to the substrate, wherein the print head is displaced transverse to the print direction with each passage.

One variant in this case is characterized in that the print head is displaced by an amount $x=i*a+a/n$, where $i=0, 1, 2, 3 \ldots$ with each passage.

To compensate for a Moiré effect, it is provided that the position of the landing points is randomized within their landing zones. Because the positions of the landing points are randomly selected within the permissible limits, repetition patterns which would be visible due to their repetition structure are avoided. The positioning of the landing points can then take place through the addition or subtraction of a randomly selected value in the position coordinates.

In a further embodiment of the method, it is provided that a pattern of landing points in a single landing zone is printed by means of more than one, advantageously multiple, nozzles. A repetition structure can also thereby be avoided.

A further option in preventing repetition structures exists in that the pattern of landing points from landing zone to landing zone is randomly displaced by one or more lateral resolution steps.

In doing so, it is possible for the actuation of the nozzles to take place randomly or pseudo-randomly for a respective landing zone.

In a further embodiment of the method, it is provided that the pattern of landing points be selected by means of a combination of nozzles with different drop volumes such that the ink quantity deposited in similar landing zones deviates by no more than 10%.

To adjust the ink quantity in a landing zone, it is possible for the metering of drops in a landing zone to occur such that those nozzles which pass over the corresponding landing zone as a result of the relative movements supply a defined number of drops to one or more landing points within the landing zone.

In doing so, it is possible for the number of drops in the nozzle actuation scheme or in the landing zone type to be specified.

In order to determine the position and the distortion, it is provided that the position of the landing zones is determined in that alignment markings on the substrate are scanned, that their actual positions are compared with target positions of a non-distorted substrate, that distortions within the substrate exceeding the linear position deviations and angle deviations of the substrate are determined therefrom, and that the position of the landing zones is calculated according to the distortions of the substrate by means of a mathematical model.

It is possible for the landing zones to be used as alignment markings.

BRIEF DESCRIPTION OF THE DRAWING FIGURES

Figure 2:
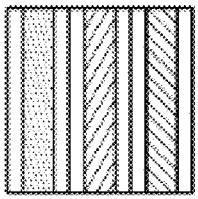
Figure 3:
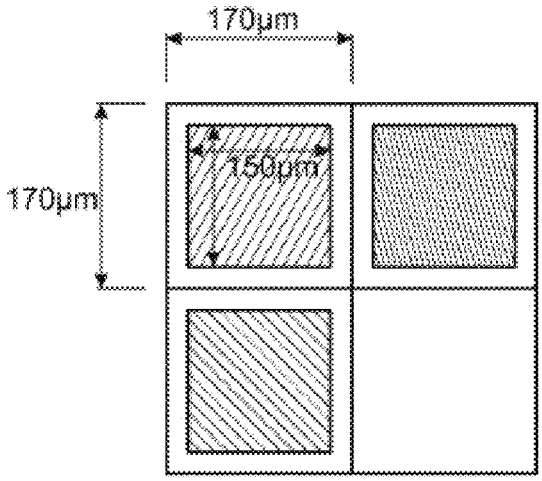
Figure 4:
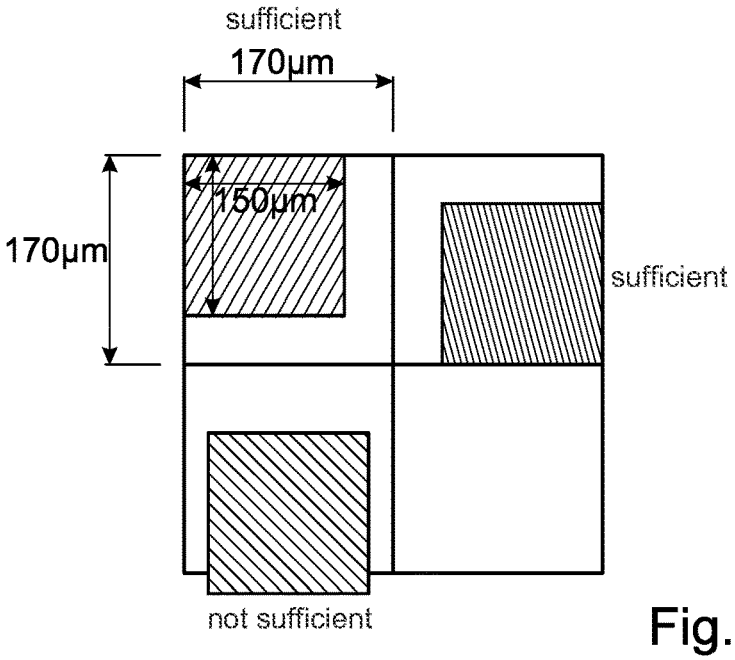
Figure 5:
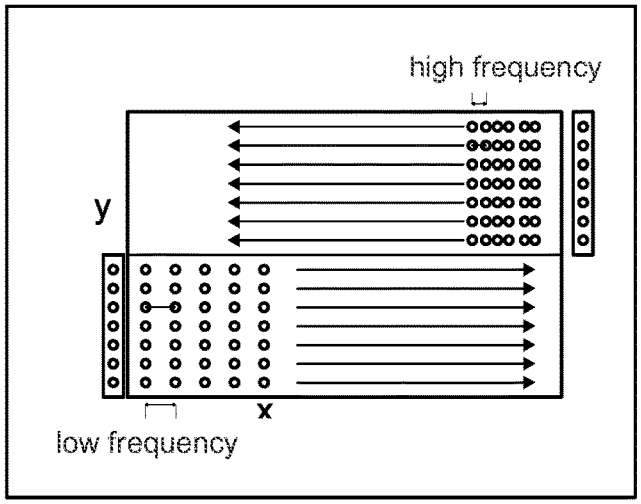
Figure 6:
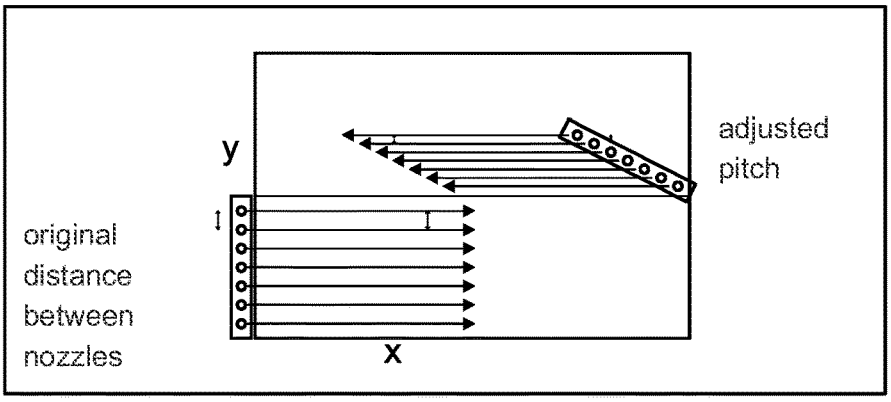
Figure 7:
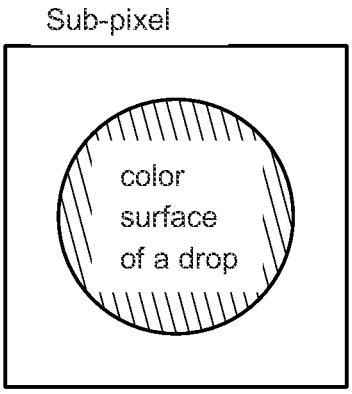
Figure 8:
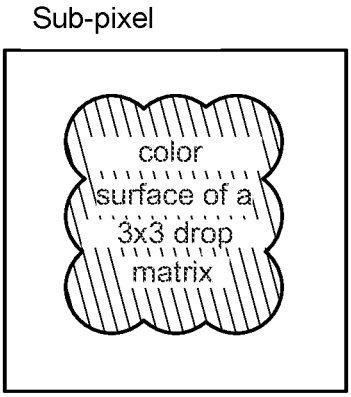
Figure 9:
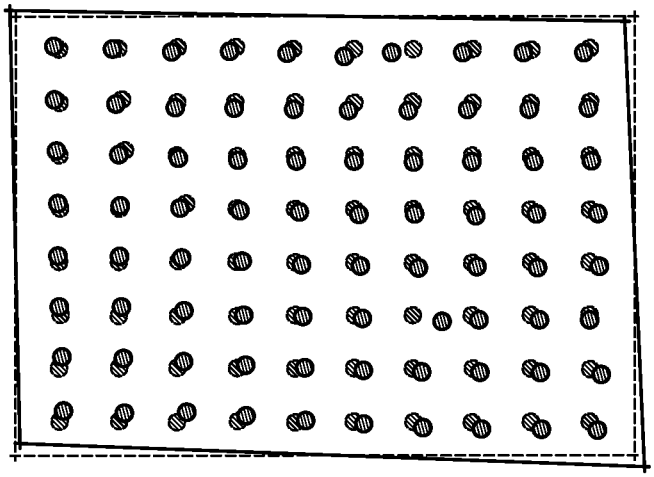
Figure 10:
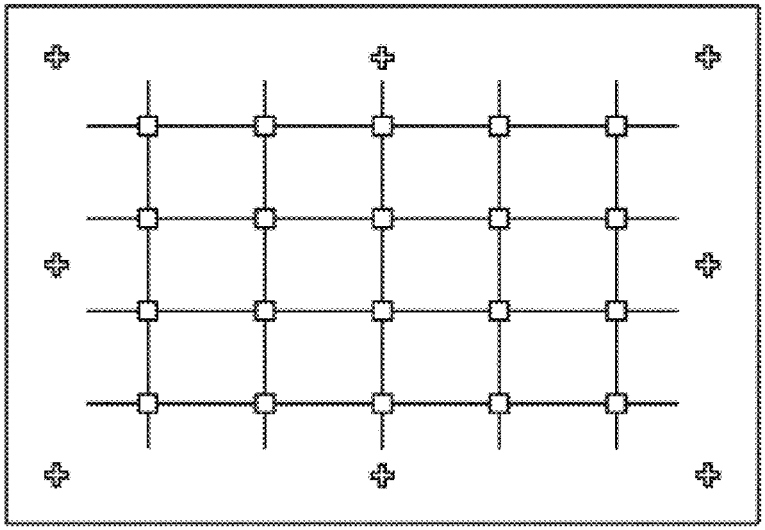
Figure 11:
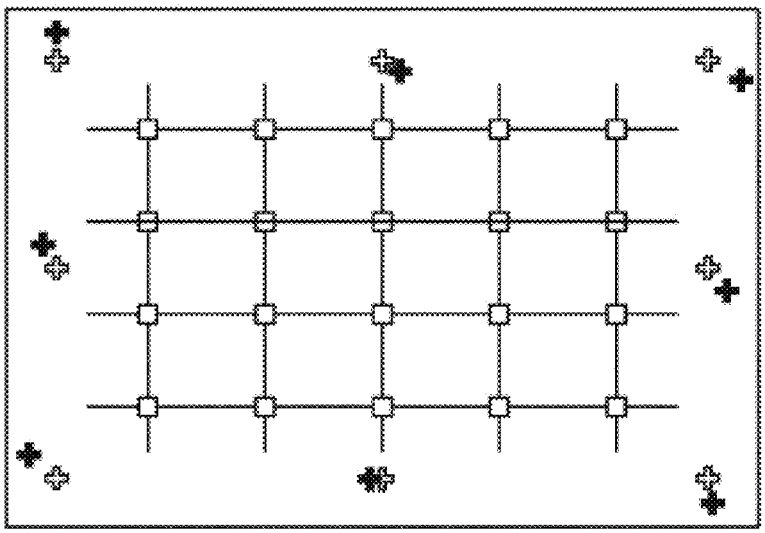
Figure 12:
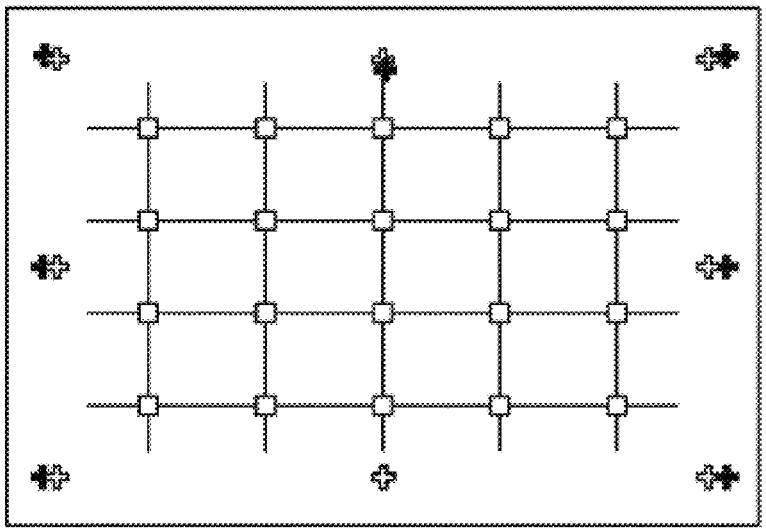
Figure 13:
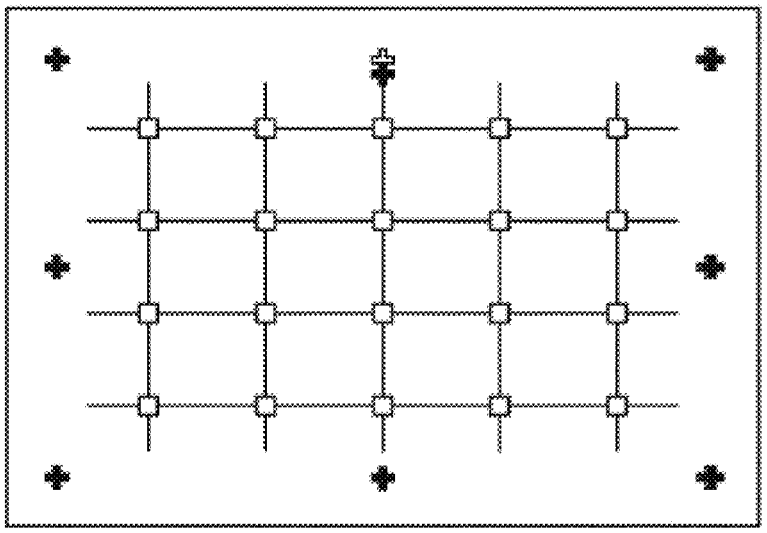
Figure 14:
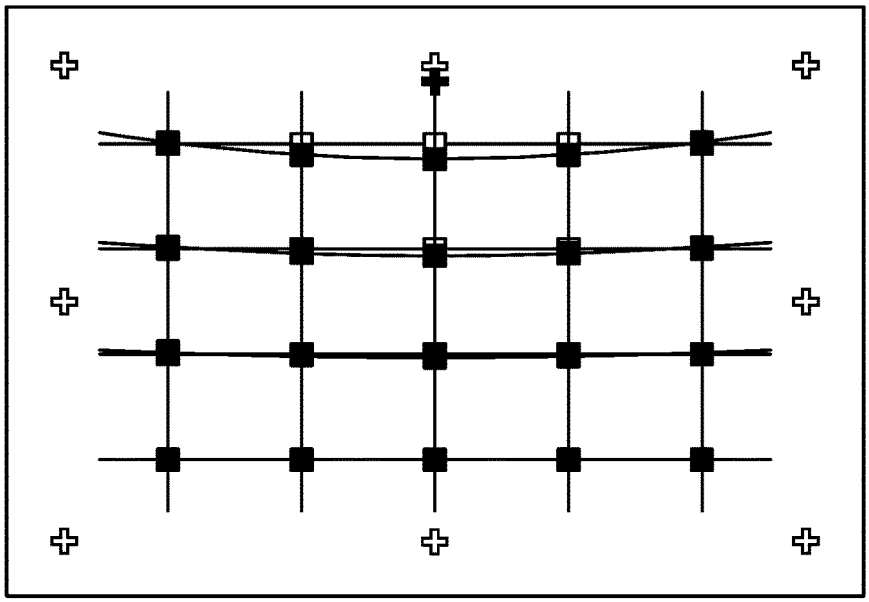
Figure 15:
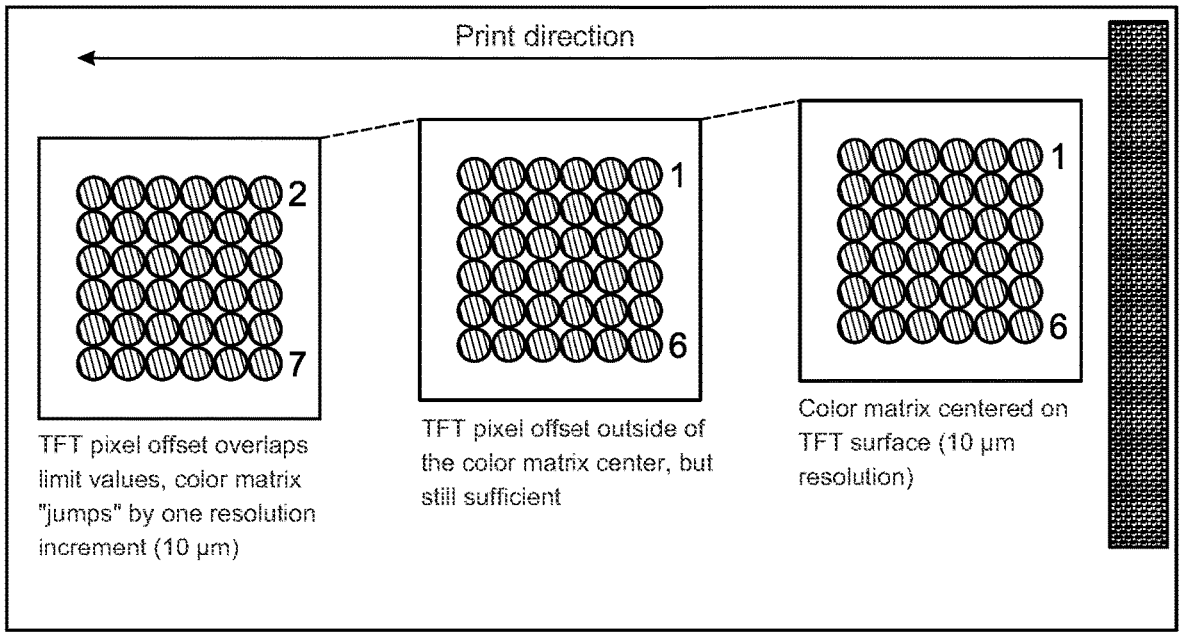
Figure 16:
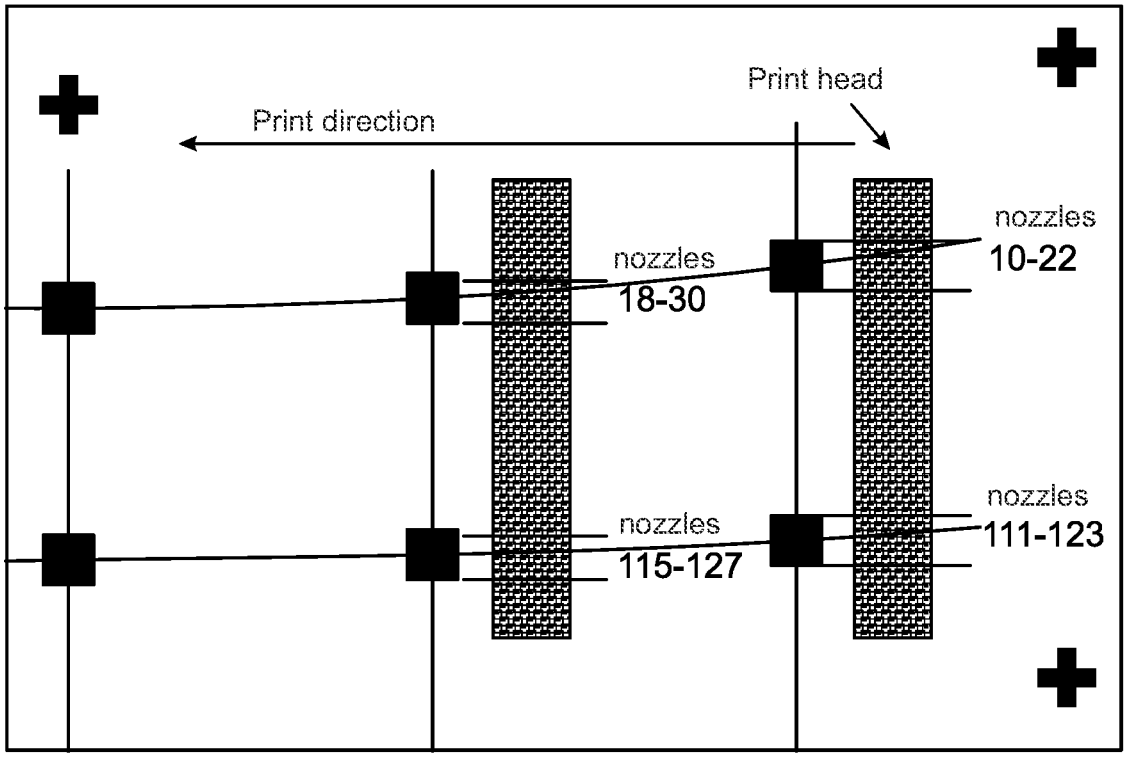
Figure 17:
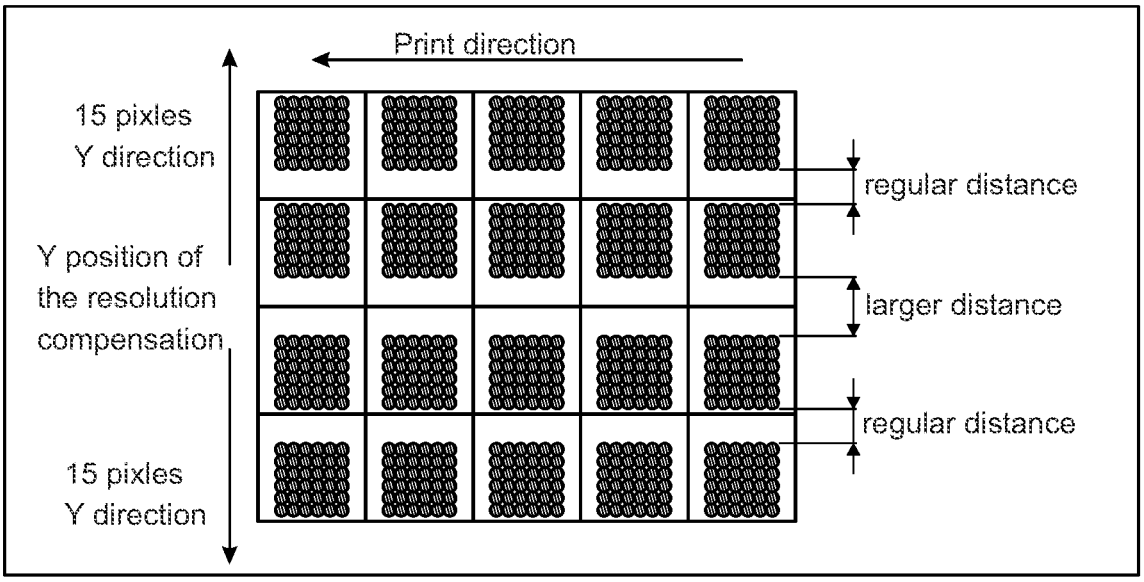
Figure 18:
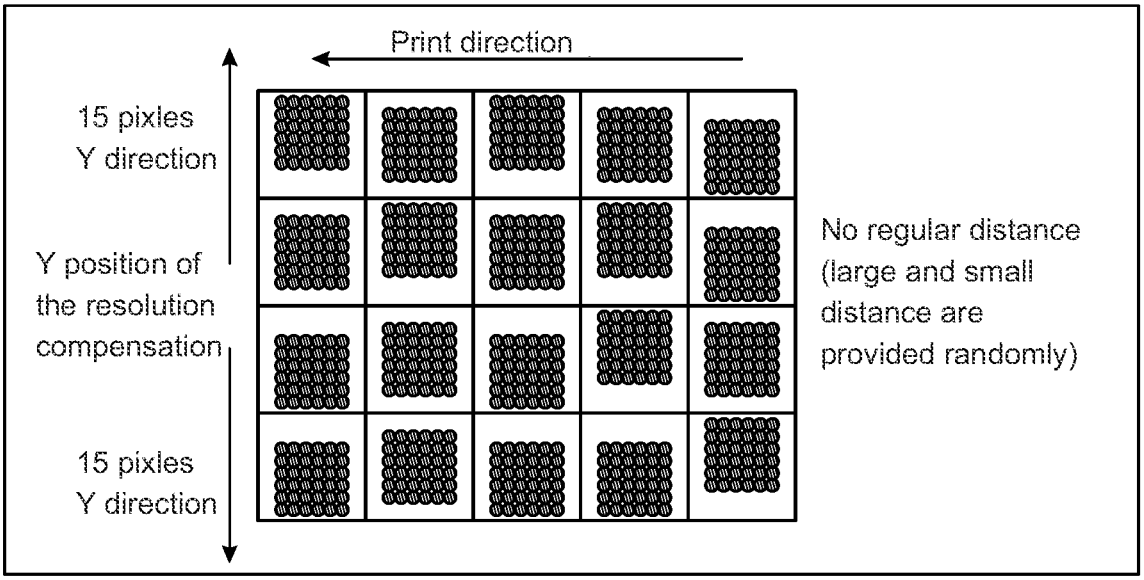

The invention shall be explained in more detail in the following by means of an exemplary embodiment. The corresponding drawings show the following:

FIG. 1 an example of an RGB(W) pixel, consisting of four landing zones;

FIG. 2 an example of an RGB pixel, consisting of three landing zones;

FIG. 3 an example of an RGB pixel in a flexible EPD;

FIG. 4 a representation of the tolerances for the color pixel position in the TFT pixel area with four landing zones;

FIG. 5 a longitudinal print resolution controlled in the print direction by the jet rate;

FIG. 6 a lateral resolution (in the Y direction), controlled by the printhead angle;

FIG. 7 a single-color drop on a landing point within a landing zone;

FIG. 8 a color pixel matrix with 3×3 landing points within a landing zone;

FIG. 9 a typical nonlinear distortion of pixel positions in flexible displays after detachment from the rigid carrier, blue=design positions, red=current positions;

FIG. 10 design data of alignment marks and pixel positions;

FIG. 11 a representation of the measurement of alignment marks;

FIG. 12 a representation of a rotation correction;

FIG. 13 a representation of an enlargement correction;

FIG. 14 a representation of a calculation of pixel positions (landing zones) along polynomials based on the determination of alignment mark positions;

FIG. 15 a diagrammatic example of the distortion compensation;

FIG. 16 a schematic representation of the functional method of controlled printhead nozzles during the linear print swath to correct the distortion;

FIG. 17 a representation that a systematic optical contrast change creates a larger gap between the pixels; and FIG. 18 a randomized pixel displacement in the Y direction;

DETAILED DESCRIPTION

The exemplary embodiment relates to a method for printing flexible substrates.

The printing of color filters directly onto the surface of an active matrix display is a known technology. As shown in FIG. 1 and FIG. 2, typically three colors (RGB=red, green, blue) are printed onto sub-pixels of a high-resolution pixel array, which leads to an RBG display. In this process, the sub-pixels represent landing zones in terms of the invention. Consequently, the pixel arrays are created by means of landing zone arrays. Customary pixel numbers in an active matrix display are between a few thousand and a few million pixels per display. Customary screen resolutions are between 50 ppi and more than 300 ppi.

Customary color filter arrays are RGB or RGBW (RGBW=red, green, blue, white; wherein W is not printed). While in this exemplary embodiment each color only has one geometry of landing zone and particularly the geometry of landing zones R, G, and B in the example is uniformly selected, generally the geometry of the landing zones may also be different and there may be more than one geometry, i.e. more than one landing zone type, per color.

A flexible EPD (EPD=electronic paper display) would be an example of a flexible substrate. As shown in FIG. 3, the original b/w (b/w=black/white) resolution in this case is 150 ppi with a 170 μm TFT pixel size (TFT=Thin Film Transistor). In order to create a color display, an RGB filter is printed above onto the b/w TFT pixel, wherein each color pixel is customarily somewhat smaller than the TFT pixel size (e.g. 150 μm). The resulting color display resolution in this case is 75 ppi.

An important criterion is the placement of color pixels consisting of landing points of inkjet drops in each TFT pixel, i.e. each landing zone, as is shown in FIG. 4. While other criteria could apply as well, a requirement is that the color pixel within the TFT pixel must not spread to the adjacent TFT pixel but rather must be within the TFT pixel area for all pixels over an active matrix display.

Typically, a print color filter, which is created using inkjet, has the following process steps:

1. A function detection camera detects multiple alignment markings (normally 4) inside the active matrix or outside the active matrix (alignment markings, which are normally created during the process sequence of the TFT array).
All TFT pixel positions in the active matrix display, in reference to the alignment markings, are known by the design of the display.
2. Depending on the placement of the display substrate on a holding table of the inkjet printer, it can compensate for an X and Y offset in that it moves the holding table or the print head to correct the start position and compensate for the rotation normally by rotating the holding table into the desired position.
3. The inkjet printer starts printing with linear printhead stripes over the substrate (the holding table normally moves in the print direction (X direction in the direction of the printing stripes) and the print heads move transverse to the print direction (Y direction).
4. Control of the landing points (longitudinal resolution) in the X direction (print direction) takes place by means of control of the output frequency of the print head and the holding table speed, as is shown in FIG. 5.
5. The resolution in the Y direction is specified by the native resolution of the print head. The resolution in the Y direction can be increased in that the print head is rotated accordingly, as shown in FIG. 6.
6. As shown in FIGS. 7 and 8, color pixels can be created in any TFT pixel by means of a single-color ink drop or by a matrix output of multiple color ink drops within any TFT (sub-)pixel area (landing zone).

Typical color inkjet printers for color filter printing on an active matrix display use print heads with a native resolution of up to 600 ppi and a single drop size of >30 μm. Active matrix display arrays typically have an orthogonal (linear/rectangular) arrangement of TFT pixels over the display area. The previously described color filter printing process is based on the precise position of each sub-pixel and outer adjustment marks, which only permit slight deviations (a few um at most). This is not a problem, because active display arrays are typically created on rigid glass substrates.

The printing process of a flexible display with high-resolution is also typically implemented while the flexible substrate is connected to a rigid glass carrier. As long as the substrate is glass or connected to glass, the array remains rigid and the subsequent color filter printing process can be based on known sub-pixel positions in reference to the alignment markings, as is specified by the design.

For a production process of the display on flexible substrates, the production flow may require color filter printing after the flexible substrate (with the finished TFT array process) is detached from the rigid glass carrier. While any flexible substrate (e.g. PEN, PI, PET, etc.) is detached from its rigid (glass) carrier, the flexible substrate experiences a significant distortion. Both the alignment markings and the TFT pixel positions of the display field are displaced nonlinearly.

The size of the displacement, as is shown in FIG. 9, increases as the display size increases. Any temperature change also has a significant expansion/retraction effect on the flexible substrate as a result. Consequently, the alignment markings no longer match the draft position, the TFT pixel position in reference to the alignment markings no longer matches the draft position, and all TFT pixel positions in the array will likewise deviate from the draft positions. Offsets may be from 5 μm to a few hundred μm. The offset values (distortion) are different for each display. However, the color filter print requires a precise pixel position; any deviation >5-10 μm would make the color filter process impossible, because color pixels could no longer be printed precisely in the TFT pixel. This maximum permissible deviation is exceeded in that the flexible substrate detaches from the rigid carrier and the flexible substrate is distorted.

As a result of this, the inkjet printer would scan the alignment markings with feature detection (e.g. at the four corners of the display) and would find a nonrectangular positioning of said alignment markings. Nonlinearly displaced TFT pixel positions cannot be determined, calculated, and compensated for. Only an average rectangular grid can be calculated and used for the print position calculation. The actual TFT pixel positions, however, deviate by more than 5-10 μm for the largest portion of the display surface, on which the print result will suffer.

The approach for overcoming the problem exists in the combination of two concepts. Firstly, a mathematical model is used to predict the pixel position on a distorted display substrate (determination of the landing zones). Secondly, a high-resolution inkjet print head is used for the color filter print, which compensates for distortions while retaining a high production throughput.

The process sequence, as shown in FIGS. 10 to 14, is the following here:

1. A detection camera scans 4 alignment markings. Depending on the display size, the required preciseness, and the distortion. Depending on the type and size of the distortion, the number of alignment markings to be scanned can increase. For a typical ~10" display size, 8 alignment markings are sufficient.

The selection of the alignment markings should be carried out such that the display distortion can be sufficiently detected. This would typically be 4 alignment marking positions on the corner of the display and 4 alignment markings on the side of the display. The closer the alignment markings are to the active surface, the better the subsequent calculation result. Alignment markings may also be used within the active matrix (alignment at the uppermost pixel of the TFT matrix; when EPD media are available, alignment features can be driven directly into the display).

2. A mathematical model is used to predict all pixel positions in the display, wherein all 8 (or more) alignment markings are considered and the best adaptation is calculated. The resulting matrix of the X and Y position of pixels on the display is a not a linear grid but a matrix of polynomial lines. In this process, it is assumed that the distortion within the active matrix generally follows the distortion which is measured at the alignment markings. In reality, there is always a certain offset between the calculated and the actual pixel position. This is acceptable as long as the deviation for all pixels is small enough.

3. The inkjet printer then receives the calculated pixel middle positions (landing zones) and a print image for each of the color pixels to be printed (landing zone type). The use of high-resolution print heads with a small drop volume enables a color pixel to be composed of many small color points (on the landing points) as a matrix. For the application discussed here, a typical drop size is 15-20 μm. For example, in order to create a color pixel of 150×150 μm, a color matrix comprising 12×12 drops can be applied, while the drops are overlaid. A typical color pixel image to be printed is squared. However, with a high resolution and small drops, other forms can also be printed in order to influence the optical performance of the color filter and to compensate for process considerations (such as nozzle output deviations).

4. With inkjet printing, each stripe can only follow one linear movement. The distortion compensation is then applied in that the high resolution of the print head and the printer accuracy are used. For example, a native 1200 dpi print head is used, which is operated at 2400 dpi. This enables drop placement every ~10 μm within only 2 print swaths. Such a resolution is high enough in order to arrange each color area to be sufficiently centered on each TFT pixel. A higher resolution is possible when more color swaths are implemented for the color pixel print. However, the throughput will be influenced in the production environment.

As shown in FIGS. 15 and 16, the actual compensation during the linear print swath takes place by controlling the individual jet nozzles, which are switched on and off during the linear swath movement. A given set of nozzles will print the color pixel along the swath as long as the middle position is within ~5 μm of the color pixel matrix. If the middle position exceeds the 5 μm limit, a nozzle in the matrix is switched off and the next nozzle on the opposite side of the matrix is switched on. In this manner, the color pixel matrix remains uniform but the color pixel jumps by ~10 μm (lateral resolution). The color pixel is always within the permitted TFT pixel area. This is implemented continuously along the print direction, whereby all color pixels can be placed precisely enough along the calculated polynomial.

5. With such type of distortion compensation approach, the inkjet printer no longer requires any mechanical rotation of the vacuum clamping device or of the print head. The rotation of the holding table is normally implemented to compensate for the rotational offset during placement of the substrate for clamping. With the approach described here, even a slight rotation of the substrate can be compensated for with the same method. The rotation of the print head is normally not necessary in order to adapt the native resolution of the print head to the required print resolution. With the approach described here, the required print resolution is achieved.

Such an approach, as previously described, may have a further problem, the solution of which is shown in the following and in FIG. 17.

With a high-resolution print head to correct pixel positions in the Y direction, a lateral resolution is used. The lateral resolution is, for example, 1200 dpi, and when printing with 2400 dpi (in two passes), the distance a between the points is 10.58333333 μm. The TFT pixel design of the display has an exact size of 170 μm (pixel to pixel). The effect is that the lateral resolution of the print head cannot be evenly divided by the resolution of the pixel size.

For example, 16 points in the Y direction result in 16×10.58333333 μm=169.33333333, which has a balance of 0.6666666 μm. This is a small offset, which is acceptable for a TFT pixel. However, all 15 TFT pixels increase the balance by ~10 μm through addition. Therefore, the color sub-pixel has to "jump" one nozzle distance (10.5 μm) after 15 TFT pixels to compensate.

Because nozzle positions are defined (given by the lateral resolution), this "jump" normally takes place along the Y direction and is uniformly distributed over the display along the X direction (print direction). The result is that [for] all 15 TFT pixels in the Y direction, the gap between two adjacent color sub-pixels is different compared to all other gaps (~10 μm). This larger gap is found on the entire Y position along the print direction and repeats every 15 TFT pixels. To the naked eye, this systematic offset is visible as a local contrast difference which is strong enough to be seen as brighter and darker lines along the print direction. The optical impression (similar to the Moiré effect) negatively impacts the optical uniformity of the brightness over the display and is unacceptable.

Depending on substrate placement (rotation) on the vacuum clamping device, these repeating lines may be in the angle direction over the display instead of straight lines along the print direction. This is due to the previously discussed rotation correction, which then overlays the resolution compensation.

In order to reduce the effect, the print resolution can be increased to 4800 dpi print 4 swaths). The resulting "jump" then occurs every 8 TFT pixels and the "jump" is then only ~5 m. This reduces the optical effect but does not eliminate it. In addition, it increases the process time by a factor of 2, which is not desirable in a mass production environment.

The better solution, which is also shown here in FIG. 18, is a random change in the "jump" positions in the Y direction along the print direction. The result is an interruption in the systematic lines, whereby the offset for the resolution compensation is not detectable to the naked eye.

LIST OF REFERENCE NUMBERS

1 Landing zone
2 Landing point
3 Print head

The invention claimed is:

1. A method for printing on a flexible substrate by means of inkjet printing, wherein landing zones, which correspond to a landing zone type, are specified on the substrate, in a nonrectangular landing zone matrix consisting of non-equally spaced landing zone lines and landing zone rows, the landing zone matrix is aligned relative to a print head such that the landing zone rows extend essentially parallel to the print direction, and the actuation of the print head is carried out such that one or more drops of one or more print head nozzles create a pattern of landing points within the landing zone, wherein the print head nozzles create imaginary nozzle lines on the substrate surface with a lateral resolution representing the distance between the nozzle lines, characterized in that the lateral resolution is selected to be large enough that the smallest distance between nozzle lines is less than the minimum distance between the landing zone rows, and that, with the landing zone matrix having distortions characterized by a plurality of adjacent landing zone lines being spaced apart by a plurality of variable distances, the position of the landing zones of a landing zone line is determined relative to the nozzle lines and consequently only those print head nozzles the nozzle line of which intersects the landing zone are actuated corresponding to a nozzle actuation scheme and the corresponding landing zone type.

2. The method according to claim 1, wherein only those print head nozzles are actuated wherein the pattern of landing points that would be created by those nozzles would be within 5 microns of a middle position of a landing zone.

3. The method according to claim 1, wherein the print head is displaced by an amount $$x = i * a + \frac{a}{n},$$

where i=0, 1, 2, 3 . . . with each passage.

4. The method according to claim 1, wherein the position of the landing points is randomized within their landing zones.

5. The method according to claim 1, wherein the lateral resolution is increased by the selection of a print head in which at least one second print head nozzle line is arranged offset with respect to a first print head nozzle line transverse to the print direction.

6. The method according to claim 1, wherein the lateral resolution is increased by means of a rotation of the print head relative to the print direction such that its print head nozzle line(s) form an angle between >0° and <90° with respect to the print direction.

7. The method according to claim 1, wherein the lateral resolution is increased by means of an n-fold traversing of the print head relative to the substrate, wherein the print head is displaced transverse to the print direction with each passage.

8. The method according to claim 1, wherein the lateral resolution is increased by the selection of a print head with a number of print nozzles in a print head nozzle line, the distance of which is less than the minimum distance between the landing zone rows.

9. The method according to claim 8, wherein the lateral resolution is increased by the selection of a print head in which at least one second print head nozzle line is arranged offset with respect to a first print head nozzle line transverse to the print direction.

10. The method according to claim 9, wherein the lateral resolution is increased by means of a rotation of the print head relative to the print direction such that its print head nozzle line(s) form an angle between >0° and <90° with respect to the print direction.

11. The method according to claim 10, wherein the lateral resolution is increased by means of an n-fold traversing of the print head relative to the substrate, wherein the print head is displaced transverse to the print direction with each passage.

12. The method according to claim 11, wherein the print head is displaced by an amount $$x = i * a + \frac{a}{n},$$

where i=0, 1, 2, 3 . . . with each passage.

13. The method according to claim 12, wherein the position of the landing points is randomized within their landing zones.

14. The method according to claim 1, wherein a pattern of landing points in a single landing zone is printed by means of more than one, advantageously multiple nozzles.

15. The method according to claim 14, wherein the pattern of landing points from landing zone to landing zone is randomly displaced by one or more steps.

16. The method according to claim 1, wherein the actuation of the nozzles takes place randomly or pseudo-randomly for a respective landing zone.

17. The method according to claim 16, wherein the pattern of landing points is selected by means of a combination of nozzles with different drop volumes such that the ink quantity deposited in similar landing zones deviates by no more than 10%.

18. The method according to claim 1, characterized in that the metering of drops in a landing zone occurs such that those nozzles which pass over the corresponding landing zone as a result of the relative movements supply a defined number of drops to one or more landing points within the landing zone.

19. The method according to claim 18, wherein the number of drops in the nozzle actuation scheme or in the landing zone type is specified.

20. The method according to claim 1, wherein the position of the landing zones is determined in that alignment markings on the substrate are scanned, in that their actual positions are compared with target positions of a non-distorted substrate, in that distortions within the substrate exceeding the linear position deviations and angle deviations of the substrate are determined therefrom, and in that the position of the landing zones is calculated according to the distortions of the substrate by means of a mathematical model.

21. The method according to claim 20, wherein landing zones are used as alignment markings.

* * * * *